US005471198A

United States Patent [19]

Newham

[11] Patent Number: 5,471,198

[45] Date of Patent: Nov. 28, 1995

[54] DEVICE FOR MONITORING THE PRESENCE OF A PERSON USING A REFLECTIVE ENERGY BEAM

[76] Inventor: Paul Newham, 707 Cypresstree, San Antonio, Tex. 78245

[21] Appl. No.: 343,259

[22] Filed: Nov. 22, 1994

[51] Int. Cl.[6] ..... G08B 13/183; G08B 23/00

[52] U.S. Cl. ..... 340/573; 340/556

[58] Field of Search ..... 340/573, 556, 340/557

[56] References Cited

U.S. PATENT DOCUMENTS

| | | | |
|---|---|---|---|
| 4,179,692 | 12/1979 | Vance | 340/573 |
| 4,196,425 | 4/1980 | Williams, Jr. et al. | 340/573 |
| 4,295,133 | 10/1981 | Vance | 340/573 |
| 4,484,043 | 11/1984 | Musick et al. | 200/85 R |
| 4,565,910 | 1/1986 | Musick et al. | 200/85 R |
| 4,583,084 | 4/1986 | Henderson et al. | 340/573 |
| 4,633,237 | 12/1986 | Tucknott et al. | 340/573 |
| 4,947,152 | 8/1990 | Hodges | 340/573 |

*Primary Examiner*—Glen Swann
*Attorney, Agent, or Firm*—Gunn, Lee & Miller

[57] ABSTRACT

An electromagnetic (EM) radiant energy beam source transmits a beam of reflectable EM energy toward the space in a hospital bed normally occupied by a patient being monitored. In one embodiment, the beam is reflected by the patient if found within the confines of the hospital bed, and the reflected beam is detected by an EM energy sensor located on the apparatus. A control logic circuit then receives data from the energy sensor regarding the level of reflected energy detected. If a certain beam intensity level has been detected, the control logic circuit sends a signal to an output relay that the patient is still in the bed. If the patient is no longer in the bed, an alternate signal is sent to the output relay. The output relay serves as an interface to an external occupancy monitoring system or may alternatively operate an alarm bell or light to indicate the absence of the patient.

19 Claims, 3 Drawing Sheets

DEVICE FOR MONITORING THE PRESENCE OF A PERSON USING A REFLECTIVE ENERGY BEAM

BACKGROUND OF THE INVENTION

1. Field of the Invention

The present invention relates generally to wave energy beam transmission and detection equipment. The present invention relates more specifically to the use of such equipment for the detection and monitoring of the presence or absence of a person from a medical bed, chair, or other supportive structure so as to ensure the safety of a patient occupying such a structure.

2. Description of the Related Art

A problem well known to medical service providers is that of making sure certain patients remain in their hospital bed. Reasons for this include the need to quickly locate the patient, administer medical treatment to the correct patient, and the prevention of patient injury. Such knowledge is particularly important when patients have become disoriented due to illness or medication.

Medical bed and chair occupancy monitoring systems have been devised to assist medical providers with monitoring the presence or absence of a person in their bed. Such systems typically are equipped with an alarm or are electronically tied to a common monitoring location such as a nurse's station. Such systems principally use some form of pressure-sensitive switch as their key sensing element. U.S. Pat. Nos. 4,484,043 and 4,565,910, both by Musick et al., describe switch mechanisms which are used to open and close a circuit to indicate the evacuation of a bed by a patient. In the Musick et al. patents, the switch apparatus is housed in a thin, rectangular cover which may be placed between the patient and the mattress or underneath the mattress. The switch devices in the Musick patents are each comprised of two rectangular conductors which run the length of the device, are parallel to each other and lie one on top of the other. The two conductors are separated at both ends by a pliable material such as foam, and are held apart from each other through the rigidity of the switching apparatus itself. The switch is activated by the pressure of the patient's body weight on the device, either directly thereon or indirectly through the mattress. Once this weight is applied, the two conductive elements come into contact, the switch is closed, and the system indicates that the patient is in the bed. When the switch is opened by the absence of the patient's weight in the bed, the system then sounds an alarm or sends a signal to the medical facility call system through an appropriate interface.

Such pressure-sensitive switching elements, as previously described, suffer from certain inherent problems. Switching elements which are placed under the mattress exhibit extremely limited sensitivity and selectivity in identifying the presence of the patient in the bed. This is due to the fact that the patient's weight in the bed is masked by the mattress itself. This masking effect tends to result in frequent false alarms due to the switch failing to close properly, as well as the failure to generate an alarm when the switch fails to open even though the patient is no longer in the bed. As for pressure-sensitive switches placed between the patient and the mattress, they must be extremely thin to afford the patient a reasonable degree of comfort. Although such switches exhibit substantially improved sensitivity and selectivity, the required thinness of the switch elements causes them to have considerably limited life. Such switches are, therefore, manufactured as disposable devices whose costs prohibit their broad acceptance and use.

It is, therefore, an object of this invention to provide a reflectable wave energy beam device, which replaces the existing pressure-sensitive switches previously described for the monitoring of the presence of a patient in a medical environment. A further object of this invention is to provide such a device which either interfaces with occupancy monitoring control modules already in use or utilizes self-contained control module circuitry and controls.

It is another object of the present invention to provide a reflectable wave energy beam device which may be used as a portable unit or may be built into or mounted on a medical bed, chair or similar structure to sense the presence or absence of a person normally occupying the structure.

It is a further object of the present invention to provide a proximity monitoring device with a limited and controlled range that can reliably detect the presence or absence of a person, thereby decreasing the number of false and unreliable alarms.

It is another object of the present invention to provide a proximity monitoring device which will eliminate patient discomfort by replacing mechanical pressure-sensitive switches in the medical bed or chair with a remotely produced and remotely sensed wave energy beam.

It is a further object of this invention to provide a proximity monitoring device which will be unaffected by patient incontinence and the association infection control concerns, static electrical build-up, or pressure-sensitive switch element degradation, as suffered by systems presently in use.

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

According to the present invention, the foregoing and other objects and advantages are attained by an electronic device able to remotely detect and monitor the presence or absence of a person within a pre-defined space. The device generally comprises a power supply, a pulsed waveform generator, a reflectable electromagnetic (EM) energy beam source, a matching EM energy sensor, a window comparator circuit, a control logic circuit, and an output relay circuit. In the preferred embodiment, the EM energy beam source emits a reflectable energy beam in the direction of a location defined as where the person occupying the bed or other support structure should safely be. The direction, focus, and intensity of the beam may be varied as the specific application may require. The energy beam may be composed of electromagnetic waves, such as visible light or infrared light, or in the alternative, may be an acoustic wave energy source. The waveform generator circuit is used to drive the energy beam source by outputting various pulsed waveforms. The pulse generator circuit is connected to the control logic circuit and receives control signals from it. These control signals direct the pulse generator to produce a variable signal to the energy beam source. Variations in this input signal cause the energy beam source to make changes in any of a number of aspects of the energy beam itself. Thus, by varying the pulsed waveform input signal into the energy beam source, changes in frequency, intensity and duration of the energy beam may be effected. In this way, the control logic circuit controls the characteristics of the reflectable energy beam.

The requirements for the energy beam are only that it be of a frequency, wavelength, and intensity as to be reflectable by the person being monitored and that the reflected beam be detectable by the energy sensor. Once the energy beam has been directed toward the pre-determined location, and has been reflected back toward the device by the presence of the patient in that location, the energy sensor detects and identifies the reflected energy. The energy sensor then transmits data about the reflected beam to a window comparator circuit which filters and amplifies the reflected beam from interfering sources detected by the energy sensor. Information on this isolated beam is then sent to a control logic circuit for processing. The control logic circuit analyzes the data regarding the reflected energy and relays a control signal to the output relay circuit indicating whether or not to initiate "alarm" mode by activating an alarm or other external monitoring circuitry. The control logic circuit may also employ an adjustable time delay component to prevent premature alarm indications.

The apparatus of the invention, using a reflective energy beam as the probe and sensor mechanism, thus reliably detects the presence or absence of a patient from a bed or other support structure without causing discomfort to the patient, and significantly reduces the occurrences of false or unreliable alarms.

Still other objects and advantages of the present invention will become readily apparent to those skilled in this art from the following detailed description, wherein multiple preferred embodiments of the invention are shown and described, simply by way of illustration of the best mode contemplated by the inventor for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION OF THE PREFERRED EMBODIMENT

As generally described above, the device of the present invention has practical application in a number of situations. The device may be used to monitor the presence of a person, animal, or object within a pre-defined space. The invention described may be used in hospitals to monitor the occupancy of medical beds, chairs, or other supportive structures whenever it may be useful to determine the status of occupancy of such structures. Outside the hospital area, the present device may be used in nursing homes, mental hospitals, and other similar institutions needing to track the presence of individuals. The invention is not limited to institutional use, but also has practical application as a single, stand-alone device. Such applications include in-home health care and presence monitoring for the increasing number of patients who choose to have medical care provided in their own homes.

Figure 1:
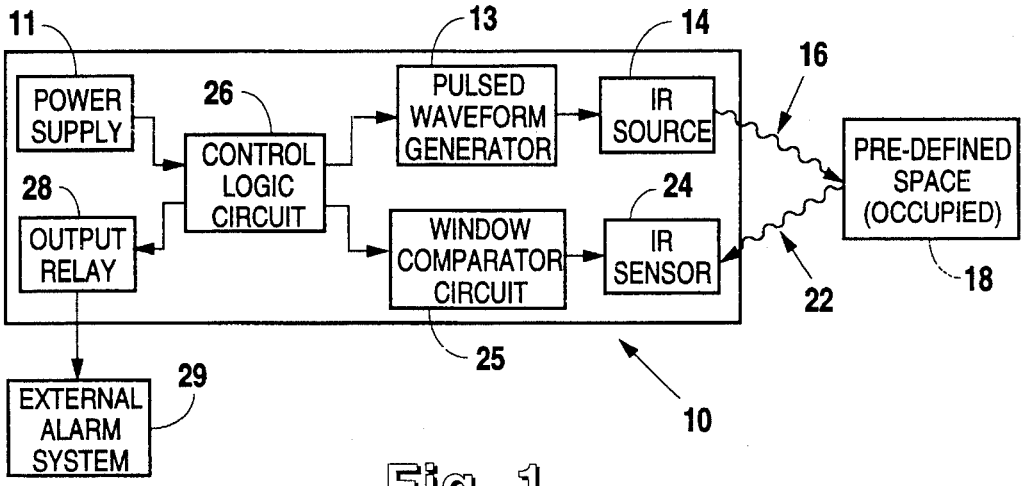
FIG. 1 is a block diagram of a preferred embodiment of the reflectable energy beam device of the present invention.

Reference is made, therefore, to FIG. 1 for a description of a first embodiment of the current invention. FIG. 1 shows a block diagram for a basic presence monitoring device (10) made up of several components, including a power supply (11). The power supply (11) may consist of an internal power source such as a battery, an external source with an appropriate feed to the device (10), or any other source of power known in the art. The next component disclosed by FIG. 1 is the infrared (IR) source (14) which provides the EM energy beam (16). It produces a focused, directed beam of radiant energy (16) detectable by the IR energy sensor (24). The radiant energy (16) is directed toward a pre-defined location (18), wherein the object (20) whose presence is to be detected is most likely to be found if in its proper location. While the present embodiment uses an IR source (14), it is understood that the energy beam source may be any of those commonly found in the art which produce radiant energy detectable by an energy sensor. Examples of such radiant energy (16) include visible light, infrared light, other invisible light, ultrasound energy, microwave energy, laser energy, radio waves, and other appropriate energy sources as they become available or are discovered. As is well known in the art, various methods exist to control the angle of dispersion of the emitted beam (16), such as mechanical structures associated with the mounting of the IR source (14). In addition to making changes in the angle of the emitted beam (16), the IR source (14) can also vary the frequency, intensity and duration of the emitted beam (16) depending on the signal input to the IR source (14). The making of these types of adjustments in the emitted beam (16) is known in the art. The IR source (14) is able to produce, direct and appropriately control the radiant energy (16) in a focused beam toward the location of the pre-defined space (18). Some of the radiant energy (16) directed at the object (20) is reflected back toward the device (10) if the object (20) is present within the pre-defined space (18). This reflected energy (22) is then detected by the IR energy sensor (24). If no object (20) is present within the pre-defined location (18), no reflected energy (22) will be directed at the IR sensor (24). In the preferred embodiment, the IR sensor (24) is able to detect the presence of the reflected energy (22) within a 4° (±2°) angle. This narrow detection angle is used to limit the range of the device (10) to the pre-defined space (18) immediately above the bed (30). The IR sensor (24) may also be equipped with shielding to ambient and incandescent light such as by physically positioning an infrared filter over the sensor (24) or by other methods standard in the practice to further reduce false alarms. The IR sensor (24) then sends data regarding the reflected energy (22) to the window comparator circuit (25) through a connection thereto. The window comparator circuit (25) isolates and amplifies the reflected signal before feeding data on that signal to the control logic circuit (26). In the preferred embodiment, the reflected signal is isolated from interference by filtering out all frequencies of the sensed signal except for the specific frequency at which the radiant energy (16) was emitted by the IR source (14). The control logic circuit (26) then uses this data from the window comparator (25) to regulate the pulse generator circuit (13), as described below, to more accurately control the beam of radiant energy (16).

The control logic circuit (26) may be composed of discrete integrated circuits or may be a computer microprocessor which is controlled by internal programming embedded in its circuitry. The control logic circuit (26) analyzes the data received from the energy sensor (24) and makes a final decision as to whether to indicate the presence or absence of the monitored object (20). The control logic circuit (26) may also make use of an adjustable time delay component. The time delay ensures that the reflected energy (22) is not detected for a preset amount of time (typically a few seconds) before the "alarm" mode is triggered. In this way, false alarms are reduced. The control logic circuit (26) then communicates the required instructions to the output relay circuit (28). The output relay (28) functions as an interface with the external occupancy monitoring system (29). The monitoring system (29) may have an alarm indication (27) such as a bell or a light, or may be part of a complex, computerized monitoring system for an entire hospital. The output relay (28) is itself capable of communicating signals from the monitoring system (29) back to the control logic circuit (26). These signals may then be interpreted by the control logic circuit (26) to make changes in the operation of the device (10), i.e., changes in beam intensity, frequency, and duration.

The pulse waveform generator (13) interfaces with both the IR source (14) and the control logic circuit (26). The pulse generator (13) produces an output of variable pulse waveforms which appropriately control various aspects of the radiant energy (16) produced by the IR energy beam source (14) as is known in the art. Such variable aspects include the intensity of the beam, the frequency of the beam, beam focus, and beam engagement. Thus, by varying the waveforms which are input to the IR source (14), the IR source (14) is able to vary the beam's intensity, frequency, focus, and overall use. The control logic circuit (26) may also be connected to the pulse generator circuit (13) to signal to the pulse generator (13) the type of waveforms to produce as input to the IR source (14) based on data the control logic circuit (26) receives ands analyzes from the window comparator circuit (25) or the external monitoring system (29) through the output relay (28). In this way, the control logic circuit (26) can regulate and coordinate the various aspects of the energy beam output from the IR source (14) by directly adjusting and controlling the pulse generator (13) and its output signal to the IR source (14). The control logic circuit (26) may thus form a closed loop circuit, resulting in a continuously monitored and adjusted, tightly focused and thereby inherently reliable monitoring energy beam (16). This improves the device's performance and efficiency.

Some preferred embodiments use a control loop to vary the transmitted EM beam (16). The devices making up the control loop (the IR source (14), pulse generator (13), and control logic circuit (26)) can each be modified to vary its respective output characteristics as is well-known in the art. Such variations, as previously mentioned, include changes in beam intensity as well as the frequency of the beam (16). At the center of the control loop is the control logic circuit (26). It receives data about the reflected beam (22) from the IR sensor (24) and the window comparator (25). After analyzing this data, the control logic circuit (26) signals the pulse generator (13) to vary the pulse output waveform to the IR source (14) thereby changing the frequency and/or intensity of the emitted beam (16). The reason for this control loop in some of the preferred embodiments is to change the frequency of the transmitted beam (16) to a frequency different from that of other EM beam sources operating within the sensing range of the device (10). This helps to optimize the operation of the device (10), particularly the receipt and detection of the reflected beam (22). The control logic circuit (26) thereby serves as a key element in the closed loop circuit, the end result of which is a continuously monitored and adjusted, tightly-focused and thereby inherently reliable monitoring energy beam (16,22).

Figure 2:
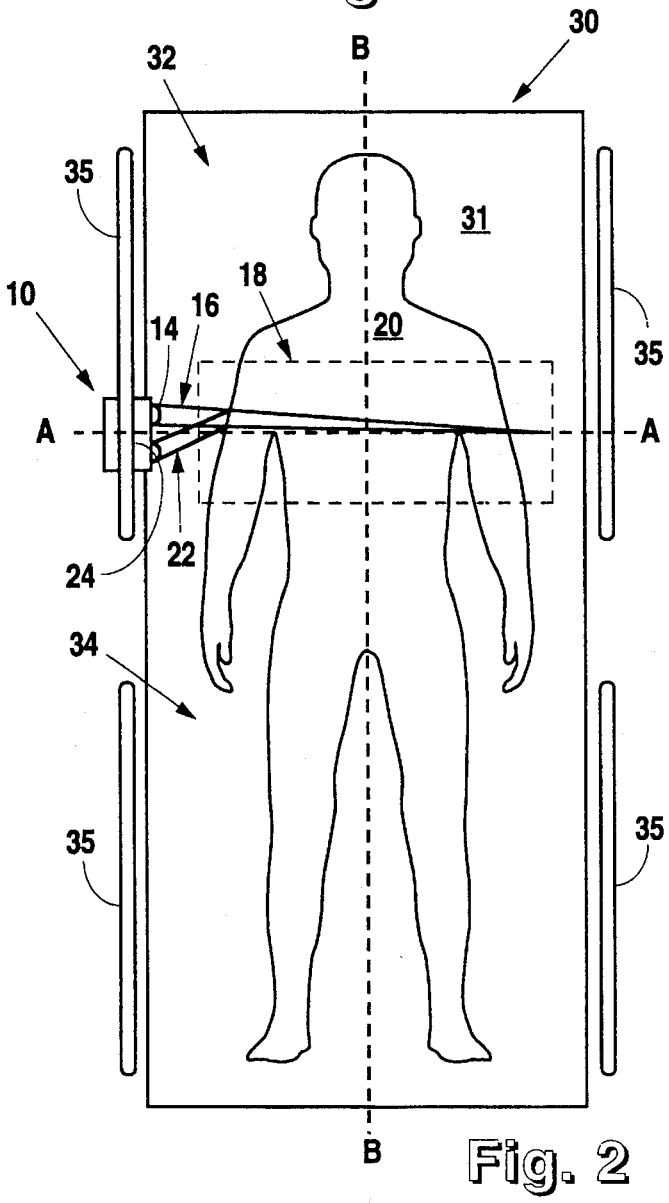
FIG. 2 is a top view of the preferred location of the reflectable energy beam device in relation to a patient in a medical bed.

FIG. 2 depicts the top view of a patient lying in a typical hospital bed to which an embodiment of the present invention has been attached for patient presence monitoring as previously described. The medical bed (30) is of a design commonly in use in hospitals and nursing homes today. The bed (30) can generally be divided into two halves, an upper half (32) and a lower half (34), each half of which is capable of being independently raised or lowered by an external means. Often connected to such beds (30) are protection side rails (38) which help ensure that the patient does not unintentionally roll out of the bed. Usually, the medical bed (30) has a pair of upper side rails (36) connected to the upper half (32) of the medical bed (30) and a pair of lower side rails (38) connected to the lower half (34) of the medical bed (30) . Each of the side rails (36,38) is independently movable. Each rail (36,38) is attached to the base or frame of the medical bed (30) so as to allow the rail (36,38) to be moved in a vertical position relative to the medical bed (30) and the patient (20) lying thereon.

As more fully shown in FIG. 3, in its completely lowered position, the top portion (37) of the upper rail (36) lies below the top of the mattress (31) on which the patient (20) lies. Each upper rail (36) has various vertical positions above its most lowered position which cause the top portion (37) of the rail (36) and the body (39) of the rail (36) to increasingly protrude above the top level of the mattress (31). Raising a rail (36) to one of its upper positions prevents the patient (20) from accidently rolling off the medical bed (30) on the side containing the raised rail (36) due to the patient's coming into contact with and being stopped by the rail (36).

It is on one of the upper side rails (36) to which the device (10) of the present invention may be attached. The upper rail (36) should be in a partially or fully raised position to allow the device (10) to correspondingly be located above the top surface of the mattress (31). Once located in such a position, the device (10) is able to monitor the presence of the person (20) on the medical bed (30). While the device (10) is shown attached to one of the upper side rails (36) of the medical bed (30), it should be noted that the device (10) could be attached to anything which would allow it to remain in a steady position above the mattress (31) of the bed (30) so that its emitted beam (16) may reach the pre-defined space (18) as herein previously described. The position of the occupancy monitoring device (10) is such that the location of the monitored patient (20) produces a reflected beam (22) from the transmitted beam (16). When the device (10) is operated in this manner, the device (10) remains in "monitor" mode as long as the patient (20) produces a reflected beam (22). When no reflected beam (22) is detected, the device (10) enters the "alarm" mode and generates the necessary signals to indicate a change in the location of the patient (20).

Figure 3:
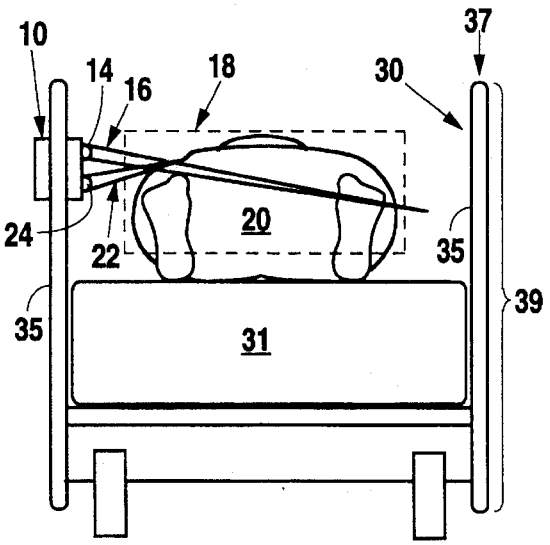
FIG. 3 is a cross-section of FIG. 2 taken along the line A—A.
Figure 4:
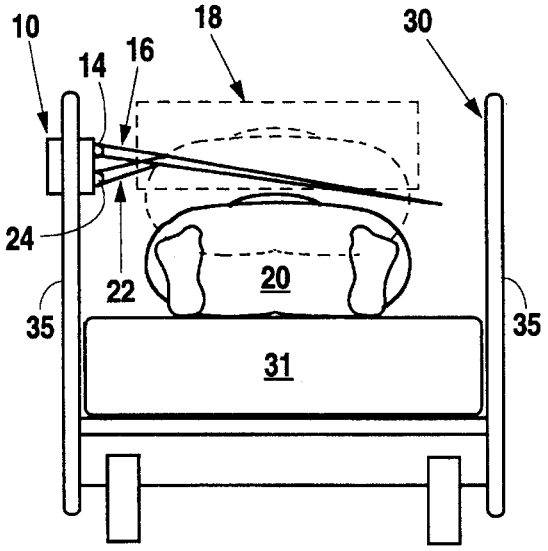
FIG. 4 is a cross-section view of another preferred embodiment of the reflectable energy beam device depicting a patient in a medical bed.

Alternatively, the device (10) may be positioned such that the emitted beam (16) is not reflected by the patient (20) when the device (10) is in "monitor" mode as shown in FIG. 4, wherein like elements are similarly numbered as in FIG. 3. In this second preferred embodiment, the emitted beam (16) is focused on a pre-defined space (18) that the patient (20) would enter when leaving the bed (30), i.e., an area a few inches above the patient's chest when the patient (20) is lying in the bed (30) or across the end of the bed (30) when all the side rails (36,38) are raised. When the patient (20) enters the pre-defined space (18), the emitted beam (16) is then reflected back toward the device (10). Once the reflected beam (22) is detected by the device (10), the device enters the "alarm" mode.

The IR source (14) and the IR sensor (24) must both be positioned on the side of the device (10) closest to the patient (20). The focused apex (40) of the transmitted beam (16) should be such that it occurs within the occupied limitations of the patient's mattress (31), specifically within the previously referred to pre-defined space (18). By producing an energy beam (16) of such focus and control, this preferred embodiment further reduces false presence determinations caused by the reflected beam's monitoring of objects outside the pre-defined space (18) when the patient (20) is not present within the pre-defined space (18).

Figure 5:
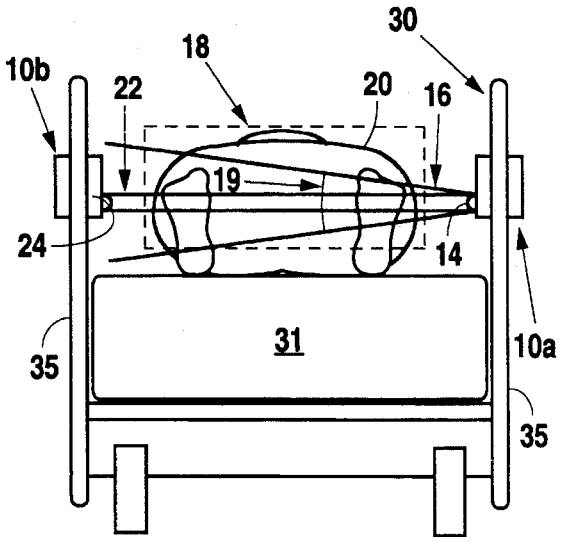
FIG. 5 is a cross-section view of yet another preferred embodiment of the present invention depicting a patient in a medical bed and the placement of the device as would be appropriate for FIGS. 2 and 3.

Reference is now made to FIG. 5 for an alternate preferred embodiment of the present invention. Many of the same elements found in FIGS. 3 and 4 are repeated in FIG. 5, like elements using like reference numerals. FIG. 5 shows the device (10) of the present invention separated into two independent parts: the emitter component (10*a*) and the receiver component (10*b*). The emitter component (10*a*) houses the IR source (14) while the receiver component (10*b*) houses the IR sensor (24). The emitter component (10*a*) is attached to one upper side rail (36), and the receiver component (10*b*) is attached to the opposite upper side rail (36). The components are positioned such that the emitted beam (16) from the emitter component (10*a*) is aimed at the IR sensor (24) on the receiver component (10*b*) so that the emitted beam (16) passes through the pre-defined location (18) where the patient (20) should be similar to the mode of operation of the device (10) as shown in FIG. 3. Once the patient (20) leaves the pre-defined location (18), the emitted beam (16) is detected by the IR sensor (24) and the device enters "alarm" mode. In this embodiment, the angle (19) of the emitted beam (16) is wider than in previous embodiments. This wider angle (19) of the emitted beam (16) eliminates the necessity of precise alignment of the emitter component (10*a*) and the receiver component (10*b*) for proper operation of the device (10). The IR sensor (24) on the receiver component (10*b*) is still limited to a sensing range of 4° (±2°) to detect the presence of the patient (20) only in the pre-defined space (18).

Figure 6:
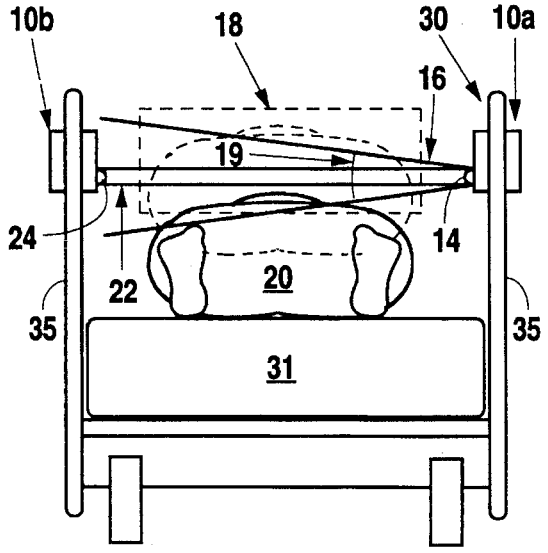
FIG. 6 is a cross-section view of yet another preferred embodiment of the present invention depicting a patient in a medical bed and showing the placement of the device as would be appropriate for operation as in FIG. 4.

Alternatively, as more fully shown in FIG. 6, the emitter component (10*a*) and the receiver component (10*b*) may be positioned so that the emitted beam (16) passes through a pre-defined location (18) defined as an area just outside that normally occupied by the patient (20) lying in the medical bed (30). In this mode of operation, the device (10) would enter "alarm" mode whenever the patient (20) interrupted receipt of the emitted beam (16) by the IR sensor (24) while exiting from the bed (30). This mode of operation is similar to that described in FIG. 4.

Figure 7:
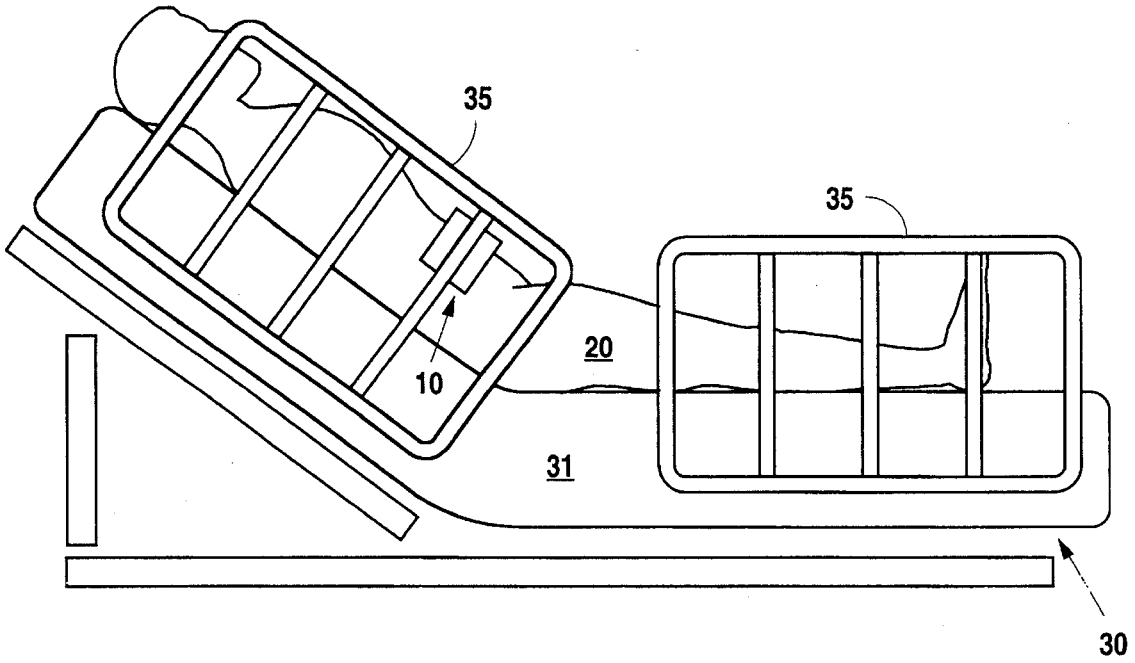
FIG. 7 is a plan view of the reflectable energy beam device in relation to a patient in a medical bed as shown in FIG. 2 taken along the line B—B.
Figure 8:
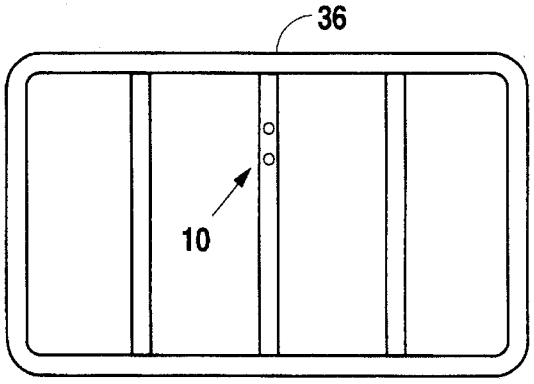
FIG. 8 is a plan view of an upper side rail of a hospital bed containing an embedded embodiment of the present invention.

FIG. 7 provides yet another view of a preferred location of the monitoring device (10) of the present invention shown with reference to the position of a monitored person (20) in a medical bed (30). The monitoring device (10) may either be a portable device affixed to the medical bed's upper side rail (36) or may be an embedded device circuit within the structure of the upper side rail (36) as depicted in FIG. 8. It should be further noted that the device (10) may be attached to or embedded within any of the side rails (36,38) connected to a medical bed (30) and that multiple devices (10) may be mounted on a single bed (30). Also, the device (10) may be attached to a mounting structure external to the medical bed (30) and may be used to monitor the location of any part of the monitored person (20), such as a limb. For example, if a leg must be held in traction within a certain pre-defined space, the present invention (10) may be positioned so as to monitor and detect any movement of the limb outside of the pre-defined position.

The apparatus (10) may also be attached to other supporting structures, such as a wheelchair, by any of the methods herein previously described. The same positioning requirements used for the medical bed would be used to determine the optimum location for the device on another support structure. Preferred positioning of the device for a wheelchair would be attachment to one of the armrests of the wheelchair with the emitted beam aimed in the direction where a person occupying the chair would most likely be found.

It is intended that the above descriptions of preferred embodiments of the structure of the present invention and the description of its mounting locations are but two or three enabling best mode embodiments for implementing the invention. Other applications are likely to be conceived of by those skilled in the art, which applications still fall within the breadth and scope of the disclosure of the present invention. The primary import of the present invention lies in its passive interaction with the patient being monitored. Its benefits derive from the versatility of application of the present invention and its low cost and accuracy. Again, it is understood that other applications of the present invention will be apparent to those skilled in the art upon a reading of the preferred embodiments and a consideration of the appended claims and drawings.

I claim:

1. An apparatus capable of monitoring the presence of a person within a pre-defined space, comprising:

a wave energy beam source;

a wave energy sensor capable of detecting reflected wave energy;

a control logic circuit electrically connected to said energy sensor and able to receive data from said energy sensor indicating the level of reflected energy detected; and an output relay connected to said control logic circuit for receipt of control signals indicating the presence of an individual within said pre-defined space for interfacing to an external monitoring system.

2. The apparatus of claim 1, wherein said energy beam source emits infrared light energy.

3. The apparatus of claim 1, wherein said energy beam source emits visible light energy.

4. The apparatus of claim 1, wherein said energy beam source emits ultrasound energy.

5. The apparatus of claim 1, wherein said energy beam source emits microwave energy.

6. The apparatus of claim 1, wherein said energy beam source emits laser energy.

7. The apparatus of claim 1, wherein said control logic circuit is a computer microprocessor.

8. The apparatus of claim 1, wherein said apparatus further comprises a means for mounting said apparatus to a hospital bed.

9. The apparatus of claim 1, wherein the external monitoring system comprises an audible alarm.

10. The apparatus of claim 1, wherein the external monitoring system comprises a visible alarm.

11. The apparatus of claim 1, wherein said apparatus is battery powered.

12. The apparatus of claim 1, wherein said output relay is further connected to said external monitoring system for communicating adjustment signals from said external monitoring system to said control logic circuit, and said control logic circuit further comprises internal programming for interpreting said adjustment signals from said external monitoring system and generating control signals based on said adjustment signals.

13. The apparatus of claim 1, wherein said apparatus is portable.

14. The apparatus of claim 1, wherein said apparatus is embedded within a support structure on which said monitored person is located.

15. An apparatus capable of monitoring the presence of a person within a pre-defined space, comprising:

a pulse generator circuit able to generate pulse waveforms;

an energy beam source connected to and powered by said pulse generator circuit able to produce a reflectable beam of energy directed toward said person so as to generate a reflected beam of energy;

an energy beam sensor capable of detecting said reflected beam and generating data regarding the intensity of said reflected beam;

a control logic circuit connected to said energy beam sensor having internal programming for interpreting said data from said energy beam sensor thereby generating control signals based on said energy beam sensor data; and an output relay connected to said control logic circuit capable of receiving said control signals from said control logic circuit thereby signaling the presence or absence of said person to an external indicating device.

16. The apparatus of claim 15, wherein said energy beam source is electromagnetic.

17. An apparatus capable of monitoring the presence of a person in a hospital bed, chair, or other support structure and mountable thereon, comprising:

a pulse generator circuit for outputting pulse waveforms;

a reflectable energy beam source, connected to and powered by said pulse generator circuit, for production of a focused beam of energy directed toward said person based on said pulse waveforms generated by said pulse generator circuit so as to produce an energy beam reflectable by said person;

an energy beam sensing circuit for detection of said energy beam, having an output for transmitting data regarding reflected beam intensity;

a window comparator circuit, connected to said output of said energy beam sensing circuit, able to produce filtered and amplified beam data at its output;

a control logic circuit, connected to said output of said window comparator circuit, having internal microprocessor programming which interprets said window comparator output circuit data to continuously adjust and control the pulse generator circuit through a first output connected to said pulse generator circuit and to generate a corresponding activation instruction at a second output based on the presence of said person; and an output relay circuit, connected to said second output of said control logic circuit, which provides an interface to an external occupancy monitoring system by regulating an input signal to said monitoring system for triggering appropriate monitoring circuitry based on said activation instruction.

18. An apparatus capable of monitoring the presence of a person in a hospital bed, chair, or other support structure and mountable thereon, comprising:

a pulse generator circuit for outputting pulse waveforms;

a reflectable energy beam source, connected to and powered by said pulse generator circuit, for production of a focused beam of energy directed toward an area immediately adjacent to said person and based on said pulse waveforms generated by said pulse generator circuit so as to produce an energy beam reflectable by said person upon entry by said person into said adjacent area;

an energy beam sensing circuit for detection of said energy beam, having an output for transmitting data regarding reflected beam intensity;

a window comparator circuit, connected to said output of said energy beam sensing circuit, able to produce filtered and amplified beam data at its output;

a control logic circuit, connected to said output of said window comparator circuit, having internal microprocessor programming which interprets said window comparator output circuit data to continuously adjust and control the pulse generator circuit through a first output connected to said pulse generator circuit and to generate a corresponding activation instruction at a second output based on the presence of said person; and an output relay circuit, connected to said second output of said control logic circuit, which provides an interface to an external occupancy monitoring system by regulating an input signal to said monitoring system for triggering appropriate monitoring circuitry based on said activation instruction.

19. An apparatus capable of monitoring the presence of a person within a predetermined location in a hospital bed, chair, or other support structure and mountable thereon, comprising:

a pulse generator circuit for outputting pulse waveforms;

an energy beam source, connected to and powered by said pulse generator circuit, for production of a focused beam of energy directed toward said predetermined location and based on said pulse waveforms generated by said pulse generator circuit;

an energy beam sensing circuit for detection of said energy beam, having an output for transmitting data regarding detected beam intensity;

a window comparator circuit, connected to said output of said energy beam sensing circuit, able to produce filtered and amplified beam data at its output;

a control logic circuit, connected to said output of said window comparator circuit, having internal microprocessor programming which interprets said window comparator output circuit data to continuously adjust and control the pulse generator circuit through a first output connected to said pulse generator circuit and to generate a corresponding activation instruction at a second output based on the presence of said person; and an output relay circuit, connected to said second output of said control logic circuit, which provides an interface to an external occupancy monitoring system by regulating an input signal to said monitoring system for triggering appropriate monitoring circuitry based on said activation instruction.

* * * * *